US008185384B2

(12) United States Patent
Sun et al.

(10) Patent No.: US 8,185,384 B2
(45) Date of Patent: May 22, 2012

(54) SIGNAL PITCH PERIOD ESTIMATION

(75) Inventors: Xuejing Sun, Rochester Hills, MI (US); Sameer Gadre, Northville, MI (US)

(73) Assignee: Cambridge Silicon Radio Limited, Cambridge (GB)

( * ) Notice: Subject to any disclaimer, the term of this patent is extended or adjusted under 35 U.S.C. 154(b) by 679 days.

(21) Appl. No.: 12/427,004

(22) Filed: Apr. 21, 2009

(65) Prior Publication Data

US 2010/0268530 A1 Oct. 21, 2010

(51) Int. Cl.
*G10L 11/04* (2006.01)
*G10L 13/00* (2006.01)

(52) U.S. Cl. ..... 704/207; 704/262

(58) Field of Classification Search ..... 704/207, 704/262

See application file for complete search history.

(56) References Cited

U.S. PATENT DOCUMENTS

| | | | | |
|---|---|---|---|---|
| 5,864,795 | A | 1/1999 | Bartkowiak | |
| 2002/0010576 | A1 * | 1/2002 | Brandel et al. | 704/207 |
| 2003/0177002 | A1 | 9/2003 | Chen | |
| 2007/0256551 | A1 * | 11/2007 | Knapp et al. | 84/722 |
| 2008/0033585 | A1 | 2/2008 | Zopf | |
| 2008/0046248 | A1 * | 2/2008 | Chen et al. | 704/262 |
| 2009/0326930 | A1 * | 12/2009 | Kawashima et al. | 704/207 |

FOREIGN PATENT DOCUMENTS

| | | | |
|---|---|---|---|
| EP | 1 335 350 | A2 | 8/2003 |
| WO | 97/31366 | A1 | 8/1997 |

OTHER PUBLICATIONS

Krubsack et al., "An Autocorrelation Pitch Detector and Voicing Decision With Confidence Measures Developed for Noise-Corrupted Speech," IEEE Transactions on Signal Processing, IEEE Service Center, New York, NY, vol. 39, No. 2, pp. 319-329, Feb. 1, 1991.

ITU-T Standard in Force (I), "Pulse Code Modulation (PCM) of Voice Frequencies; G.711 Appendix I; A high quality low-complexity algorithm for packet loss concealment with G.711," International Telecommunication Union, Geneva, Switzerland, Sep. 1, 1999.

International Preliminary Report on Patentability, WIPO, Oct. 25, 2011.

Perkins et al., "A survey of packet-loss recovery techniques for streaming audio," IEEE Network Magazine, Sep./Oct. 1998.

"A high quality low-complexity algorithm for packet loss concealment with G.711," ITU-T Recommendation G.711 Appendix I, 1999.

Svensson et al., "Implementation aspects of a novel speech packet loss concealment method," ISCAS 2005, pp. 2867-2870, vol. 3, Issue 23-26.

Chu, Speech Coding Algorithms: Foundation and Evolution of Standardized Coders, Wiley, 2003.

* cited by examiner

*Primary Examiner* — James S. Wozniak
*Assistant Examiner* — Neeraj Sharma
(74) *Attorney, Agent, or Firm* — Novak Druce DeLuca + Quigg LLP

(57) ABSTRACT

A method and apparatus for estimating the pitch period of a signal. The method includes identifying a first candidate pitch period by performing a search only over a first range of potential pitch periods. The method further includes determining a second candidate pitch period by dividing the first candidate pitch period by an integer, wherein the second candidate pitch period is outside the first range of potential pitch periods. The method further includes selecting as the estimate of the pitch period of the signal the smaller of the candidate pitch periods that is such that portions of the signal separated by that candidate pitch period are well correlated.

19 Claims, 6 Drawing Sheets

SIGNAL PITCH PERIOD ESTIMATION

FIELD OF THE INVENTION

The present invention relates to estimating the pitch period of a signal, and in particular to targeting candidates for such an estimation. The invention is particularly applicable to estimating the pitch period of a voice signal for use in packet loss concealment methods.

BACKGROUND OF THE INVENTION

Wireless and voice-over-internet protocol (VoIP) communications are subject to frequent degradation of packets as a result of adverse connection conditions. The degraded packets may be lost or corrupted (comprise an unacceptably high error rate). Such degraded packets result in clicks and pops or other artefacts being present in the output voice signal at the receiving end of the connection. This degrades the perceived speech quality at the receiving end and may render the speech unrecognisable if the packet degradation rate is sufficiently high.

Broadly speaking, two approaches are taken to combat the problem of degraded packets. The first approach is the use of transmitter-based recovery techniques. Such techniques include retransmission of degraded packets, interleaving the contents of several packets to disperse the effect of packet degradation, and addition of error correction coding bits to the transmitted packets such that degraded packets can be reconstructed at the receiver. In order to limit the increased bandwidth requirements and delays inherent in these techniques, they are often employed such that degraded packets can be recovered if the packet degradation rate is low, but not all degraded packets can be recovered if the packet degradation rate is high. Additionally, some transmitters may not have the capacity to implement transmitter-based recovery techniques.

The second approach taken to combating the problem of degraded packets is the use of receiver-based concealment techniques. Such techniques are generally used in addition to transmitter-based recovery techniques to conceal any remaining degradation left after the transmitter-based recovery techniques have been employed. Additionally, they may be used in isolation if the transmitter is incapable of implementing transmitter-based recovery techniques. Low complexity receiver-based concealment techniques such as filling in a degraded packet with silence, noise, or a repetition of the previous packet are used, but result in a poor quality output voice signal. Regeneration based schemes such as model-based recovery (in which speech on either side of the degraded packet is modelled to generate speech for the degraded packet) produce a very high quality output voice signal but are highly complex, consume high levels of power and are expensive to implement. In practical situations interpolation-based techniques are preferred. These techniques generate a replacement packet by interpolating parameters from the packets on one or both sides of the degraded packet. These techniques are relatively simple to implement and produce an output voice signal of reasonably high quality.

Pitch based waveform substitution is a preferred interpolation-based packet degradation recovery technique. Voice signals appear to be composed of a repeating segment when viewed over short time intervals. This segment repeats periodically with a time period referred to as a pitch period. In pitch based waveform substitution, the pitch period of the voiced packets on one or both sides of the degraded packet is estimated. A waveform of the estimated pitch period or a multiple of the estimated pitch period is then used (or repeated and used) as a substitute for the degraded packet. This technique is effective because the pitch period of the degraded voice packet will normally be substantially the same as the pitch period of the voice packets on either side of the degraded packet.

In pitch based waveform substitution techniques, discontinuities at the boundaries between the replacement packet and the remaining signal can often be detected as artefacts in the output voice signal. Cross fading the signals on either side of a boundary using an overlap add function is used to reduce such discontinuities. Pattern matching methods have also been proposed.

Many methods are used to estimate the pitch period of a voice signal. For a typical one of these methods, the calculations involved in estimating the pitch period accounts for over 90% of the algorithmic complexity in the pitch based waveform substitution technique. Although the complexity level of the calculation is low, it is significant for low-power platforms such as Bluetooth. In order to correctly determine the pitch period of a voice signal, a wide predefined range of pitch period values is analysed, for example from 2.5 ms (for a person with a high voice) to 16 ms (for a person with a low voice). For most pitch period determination algorithms, the wider the pitch period range used, the higher the computational complexity.

One way to reduce the computational complexity is to reduce the number of calculations that the algorithm computes. ITU-T Recommendation G.711 Appendix 1, "A high quality low-complexity algorithm for packet loss concealment with G.711" reduces the number of calculations by using a two phase approach to pitch period estimation. In the first phase, a coarse search is performed over the entire predefined range of pitch periods to determine a rough estimate of the pitch period. In the second phase, a fine search is performed over a refined range of pitch periods encompassing the rough estimate of the pitch period. A more accurate refined estimate of the pitch period can therefore be determined. The number of calculations that the algorithm computes is therefore reduced compared to an algorithm that performs a fine search over the entire predefined range of pitch periods.

U.S. patent application Ser. No. 11/734,824 proposes a two phase approach to pitch period estimation that further reduces the number of calculations that the algorithm computes. In this application a coarse search is performed on a decimated signal over the entire predefined range of pitch periods. On identifying an initial best candidate for the pitch period, a refined range of pitch periods is calculated centred on the initial best candidate. Pitch periods at the midpoints between the initial best candidate and the ends of the refined range are analysed. If preferential to the initial best candidate, one of these midpoint pitch periods is taken as a refined best candidate for the pitch period. Further bisectional searches may be performed to yield a more accurate estimate of the pitch period. The number of calculations that the algorithm computes is therefore reduced compared to an algorithm that performs a fine search over the entire refined range of pitch periods.

Although these approaches reduce the number of calculations that the algorithms compute, computational complexity associated with estimating the pitch period remains a problem, particularly with low-power platforms such as Bluetooth.

Additionally, pitch period determination algorithms generally involve comparing portions of a signal separated by lag values. The algorithm selects the lag value associated with the most similar portions to be the estimate of the pitch period. However, portions of the signal separated by multiples of the pitch period will also be very similar. A common problem with pitch period detection algorithms is that a multiple of the pitch period is selected as the estimate of the pitch period.

Chu, Wai C. Speech coding algorithms: foundation and evolution of standardised coders (Wiley, 2003) discloses a method for checking for multiples of a pitch period once an estimate of the pitch period has been determined using an autocorrelation algorithm. The pitch period estimate is divided by one or more integers to form check points. If a check point yields a sufficiently high autocorrelation value it is used as the refined estimate of the pitch period.

It is desirable to use a multiple checking algorithm such as the one described above in order to increase the accuracy of the pitch period estimate. However, such checking algorithms increase the computational complexity associated with estimating the pitch period.

There is thus a need for an improved method of estimating the pitch period of a signal that increases the accuracy of the estimate by reducing the likelihood that the estimate is a multiple of the 'true' pitch period, but that also reduces the computational complexity associated with the estimation.

SUMMARY OF THE INVENTION

According to a first aspect of this disclosure, there is provided a method of estimating the pitch period of a signal comprising: identifying a first candidate pitch period by performing a search only over a first range of potential pitch periods; determining a second candidate pitch period by dividing the first candidate pitch period by an integer, the second candidate pitch period being outside the first range of potential pitch periods; and selecting as the estimate of the pitch period of the signal the smaller of the candidate pitch periods that is such that portions of the signal separated by that candidate pitch period are well correlated.

Suitably, the high bound of the first range of potential pitch periods is the largest potential pitch period.

Suitably, the low bound of the first range of potential pitch periods is half the largest potential pitch period.

Suitably, the integer is such that the second candidate pitch period is greater than the smallest potential pitch period.

Suitably, the method comprises identifying a first candidate pitch period using a pitch period detection algorithm.

Suitably, the pitch period detection algorithm is a normalised cross correlation algorithm.

Suitably, the signal is sampled, the first candidate pitch period is a first number of samples and the second candidate pitch period is a second number of samples, wherein the second number of samples is determined by: dividing the first number of samples by an integer; and selecting the whole number nearest to the division result to be the second number of samples.

Suitably, the method further comprises correlating portions of the signal separated by the first candidate pitch period to form a first correlation value, and correlating portions of the signal separated by the second candidate pitch period to form a second correlation value.

Suitably, the method comprises selecting as the estimate of the pitch period of the signal the second candidate pitch period if the second correlation value is greater than a predetermined proportion of the first correlation value.

Suitably, the method comprises selecting as the estimate of the pitch period of the signal the first candidate pitch period if the second correlation value is less than a predetermined portion of the first correlation value.

Suitably, the method comprises selecting as the estimate of the pitch period of the signal the candidate pitch period associated with the larger of the correlation values.

Suitably, the method further comprises decimating the signal prior to identifying the first candidate pitch period.

According to a second aspect of this disclosure there is provided a method of generating a replacement portion to replace a degraded portion of the signal comprising: selecting a sample of the signal that precedes or follows the degraded portion by a multiple of an estimated pitch period; and forming the replacement portion from the selected sample and samples successive to the selected sample; wherein the estimated pitch period is determined according to the first aspect of this disclosure.

Suitably, the multiple is one or an integer greater than one.

Suitably, the method further comprises, on replacing the degraded portion with the replacement portion, applying an overlap-add algorithm to a boundary between the replacement portion and a portion of the signal adjacent to the replacement portion.

Suitably, the method further comprises refining the estimate of the pitch period of the signal by: for each candidate pitch period of a set of candidate pitch periods including the estimated pitch period and further candidate pitch periods proximal to the estimated pitch period, determining a geometric distance between portions of the signal separated by that candidate pitch period; and selecting as the refined estimated of the pitch period of the signal the candidate pitch period of the set of candidate pitch periods with the smallest associated geometric distance.

According to a third aspect of this disclosure there is provided a method of generating a replacement portion to replace a degraded portion of the signal comprising: selecting a sample of the signal that precedes or follows the degraded portion by a multiple of a refined estimated pitch period; and forming the replacement portion from the selected sample and samples successive to the selected sample; wherein the refined estimated pitch period is determined according to the above method.

Suitably, the method comprises, for each candidate pitch period of the set of candidate pitch periods, determining a geometric distance between a first portion of the signal and a second portion of the signal, wherein the first portion is proximal to and before or after the degraded portion, and the second portion is separated from the first portion by that candidate pitch period.

Suitably, the method comprises for each candidate pitch period of the set of candidate pitch periods, determining a geometric distance by determining a first geometric distance between a first portion of the signal and a second portion of the signal, wherein the first portion is proximal to and before the degraded portion and the second portion is separated from the first portion by that candidate pitch period; determining a second geometric distance between a third portion of the signal and a fourth portion of the signal, wherein the third portion is proximal to and after the degraded portion and the fourth portion is separated from the third portion by that candidate pitch period; and selecting the average of the first geometric distance and the second geometric distance to be the geometric distance.

Suitably, the method comprises: identifying a first candidate pitch period using a pitch period detection algorithm that compares portions of the signal each consisting of N samples; and for each candidate pitch period of the set of candidate pitch periods, determining a geometric distance between portions of the signal each consisting of L samples, wherein L is less than N.

Suitably, the method further comprises, on replacing the degraded portion with the replacement portion, applying an overlap-add algorithm to a boundary between the replacement portion and a portion of the signal adjacent to the replacement portion.

According to a fourth aspect of this disclosure there is provided a pitch period estimation apparatus, comprising: a candidate pitch period identification module configured to identify a first candidate pitch period of a signal by performing a search only over a first range of potential pitch periods; a processing module configured to determine a second candidate pitch period of the signal by dividing the first candidate pitch period by an integer, the second candidate pitch period being outside the first range of potential pitch periods; and a selection module configured to select as the estimate of the pitch period of the signal the smaller of the candidate pitch periods that is such that portions of the signal separated by that candidate pitch period are well correlated.

BRIEF DESCRIPTION OF THE DRAWINGS

The present disclosure will now be described by way of example with reference to the accompanying drawings. In the drawings.

DETAILED DESCRIPTION OF THE INVENTION

Figure 1:
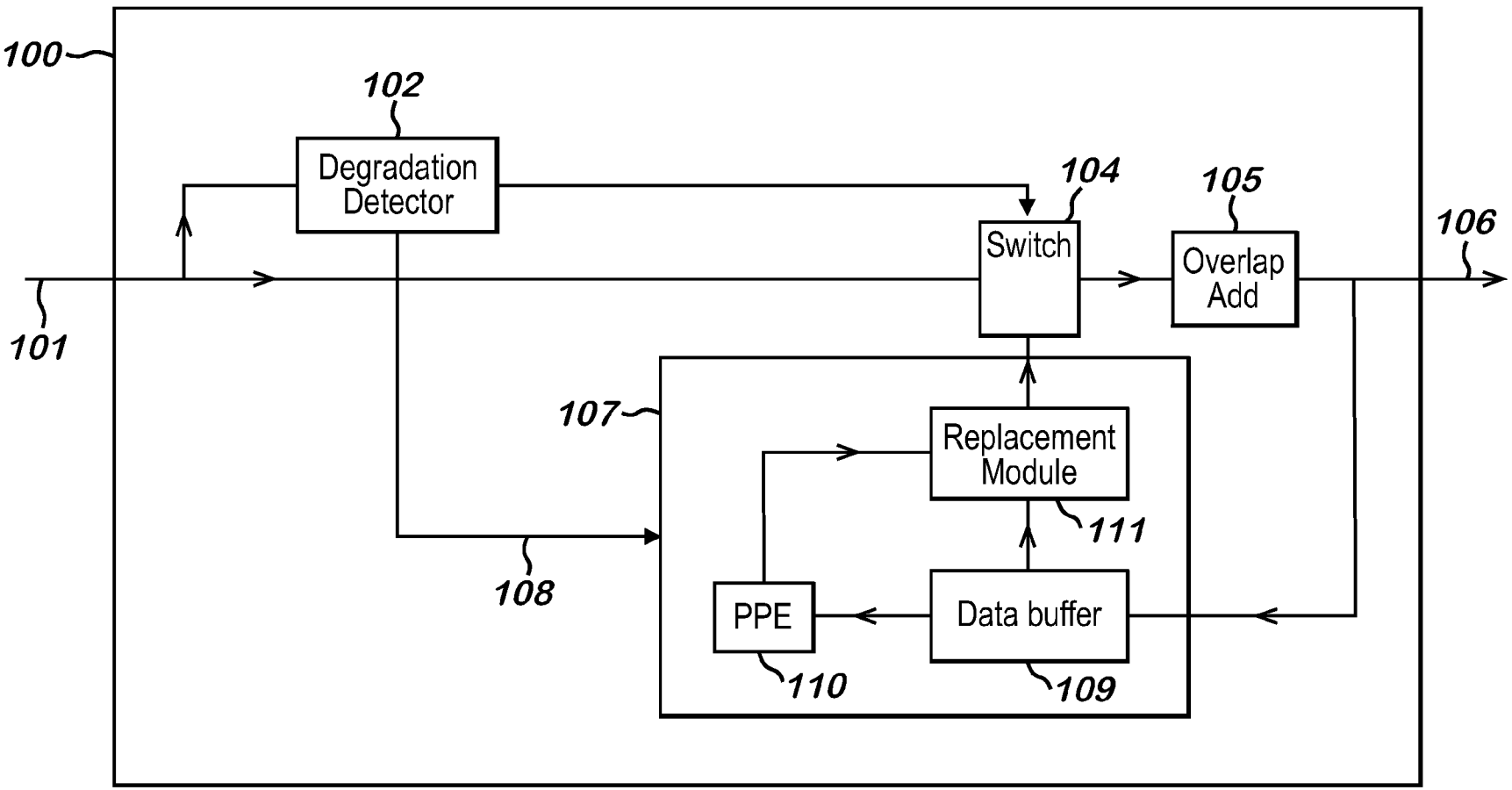
FIG. 1 is a schematic diagram of a signal processing apparatus according to the present disclosure.

FIG. 1 shows a schematic diagram of the general arrangement of a signal processing apparatus. On FIG. 1, solid arrows terminating at a module indicate control signals. Other arrows indicate the direction of travel of signals between the modules.

A data stream is input to signal processing apparatus 100 on line 101. Line 101 is connected to an input of degradation detector 102. A first control output of degradation detector 102 is connected to an input of switch 104. Line 101 is connected to a further input of switch 104. An output of switch 104 is connected to an input of overlap-add module 105. A first output of overlap-add module 105 is connected to an output of the signal processing apparatus 100 on line 106. The signal processing apparatus further comprises a degradation concealment module 107. A second control output of degradation detector 102 is connected to a control input of degradation concealment module 107 on line 108. Degradation concealment module 107 comprises a data buffer 109, a pitch period estimation module 110 and a replacement module 111. A second output of overlap-add module 105 is connected to an input of data buffer 109. A first output of data buffer 109 is connected to an input of the pitch period estimation module 110. A second output of data buffer 109 is connected to a first input of replacement module 111. An output of pitch period estimation module 110 is connected to a second input of replacement module 111. An output of replacement module 111 is connected to a third input of switch 104.

In operation, signals are processed by the signal processing apparatus of FIG. 1 in discrete temporal parts. The following description refers to processing packets of data, however the description applies equally to processing frames of data or any other suitable portions of data. These portions of data are generally of the order of a few milliseconds in length.

Figure 2:
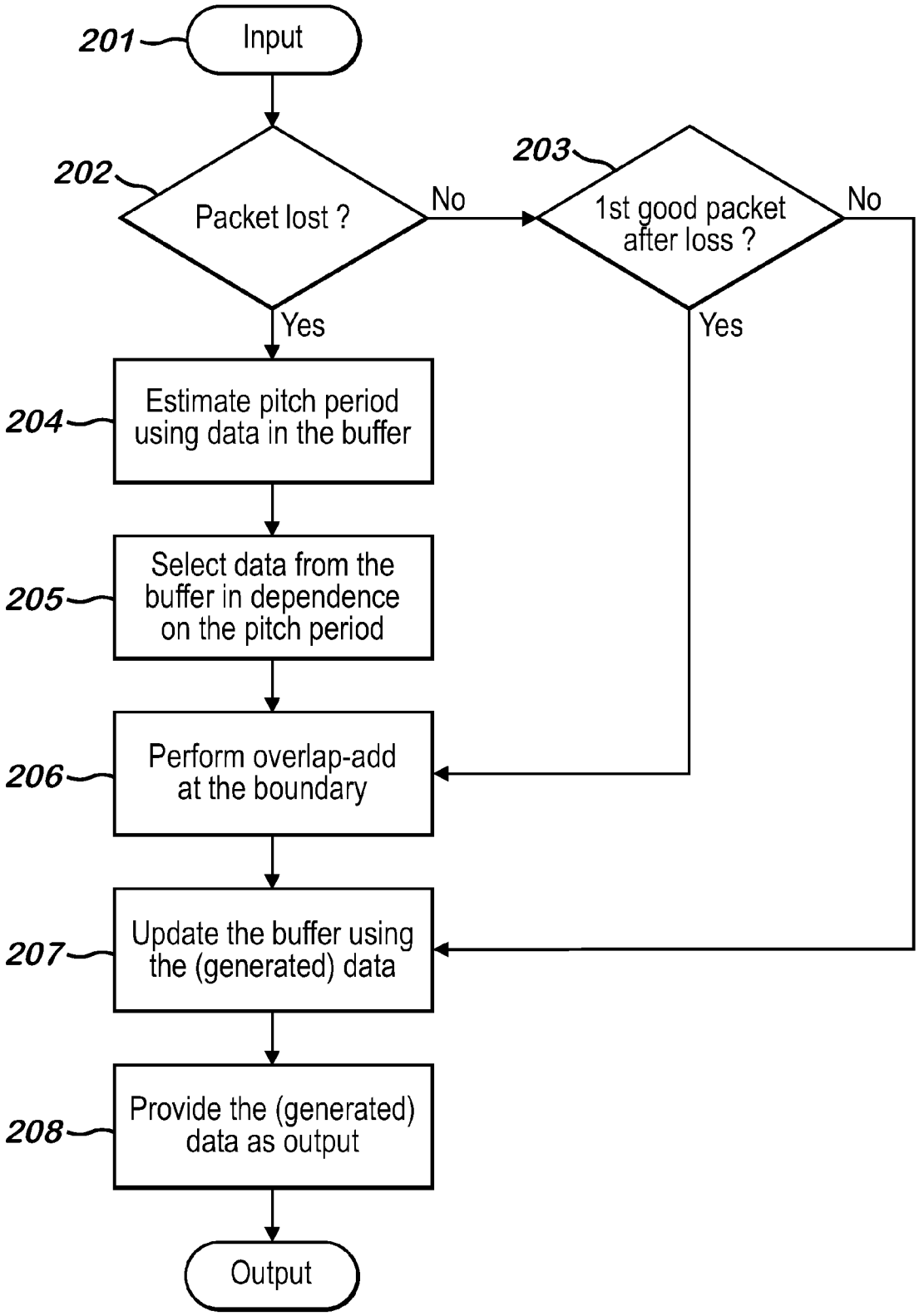
FIG. 2 is a flow chart illustrating the method by which signals are processed by the apparatus of FIG. 1.

The method of processing a data stream input to apparatus 100 will be described with reference to the flow chart of FIG. 2. In step 201 of FIG. 2, each packet of the voice signal is sequentially input into the signal processing apparatus 100 on line 101. At step 202, each packet is input to the degradation detector 102. For each packet, the degradation detector 102 determines whether the packet is degraded. The degradation detector 102 sends a control signal to degradation concealment module 107 on line 108 indicating whether the packet is degraded or not. If the packet is determined to be degraded then the signal processing apparatus discards the packet and generates a replacement packet using degradation concealment module 107.

The method and apparatus described herein are suitable for implementation in Bluetooth devices. Bluetooth packets comprise a header portion preceding the payload portion. A Header Error Check (HEC) is performed on the header portion of the packet. The HEC is an 8-bit cyclic redundancy check (CRC). The degradation detector 102 determines the packet to be degraded if the HEC fails.

If the packet is not degraded, then the degradation detector 102 outputs a control signal to switch 104 which controls the switch 104 to pass the packet to the input of overlap-add module 105.

At step 203, if the packet is the first good packet after a degraded packet then overlap-add module 105 applies an overlap-add algorithm at the concatenation point (the ending portion of the replacement packet for the degraded packet and the beginning portion of the good packet) to reduce any discontinuity at the boundary between the replacement packet and the good packet. If the packet is not the first good packet after a degraded packet then the packet is output from overlap add-module 105 unchanged.

At step 207, the packet output from the overlap-add module 105 is stored in data buffer 109. The packet output from the overlap-add module 105 is also output from the signal processing apparatus 100 on line 106.

If the packet is degraded, then the degradation detector 102 outputs a control signal on line 108 to the degradation concealment module 107 controlling it to generate a replacement packet. If the packet is degraded then the degradation detector 102 does not control the switch 104 to connect the degraded packet to overlap-add module 105. In this case, the degradation detector 102 controls the switch 104 to connect the output of the degradation concealment module 107 to the output of the signal processing apparatus 100 on line 106.

The control signal on line 108 sent to the degradation concealment module 107 controls the degradation concealment module 107 to perform the following operations. Data buffer 109 is enabled to output a data packet or packets to pitch period estimation module 110. The data packet or packets output by the data buffer 109 are proximal to the degraded packet. Suitably, the data packet or packets output by the data buffer are those most recently decoded or most recently generated by a packet concealment operation. Alternatively, the data buffer may store and output packets from the data stream prior to the packets being decoded. The packet or packets output by the data buffer may have preceded the degraded packet in the data stream or followed the degraded packet in the data stream.

At step 204, the pitch period estimation module 110 estimates the pitch period of the packet or packets it receives. This estimate is used as an estimate of the pitch period of the degraded packet.

The pitch period estimation module 110 outputs the estimated pitch period to the replacement module 111. At step 205, the replacement module 111 selects data from the data buffer 109 in dependence on the estimated pitch period. The selected data is used as a replacement for the degraded packet.

Suitably, the replacement module 111 performs a pitch-based waveform substitution. Suitably, this involves generating a waveform at the pitch period estimated by the pitch period estimation module 110. The waveform is repeated as a replacement for the degraded packet. If the degraded packet is shorter than the estimated pitch period, then the generated waveform is a fraction of the length of the estimated pitch period. Suitably, the generated waveform is slightly longer than the degraded packet, such that it overlaps with the packets on either side of the degraded packet. The overlap-add module 105 advantageously uses the overlaps to fade the generated waveform of the degraded packet into the received signal on either side thereby achieving smooth concatenation.

The replacement module 111 generates the waveform using the data stored sequentially in the data buffer 109. This data includes both good (non-degraded) data and replacement data generated by the degradation concealment module 107. Advantageously, the data buffer 109 has a longer length (stores more samples) than two times the maximum pitch period (measured in samples). The replacement module counts back sequentially, from the most recently received sample in the data buffer, by a number of samples equal to the estimated pitch period. The sample that the replacement module counts back to is taken to be the first sample of the generated waveform. The replacement module 111 takes sequential samples up to the number of samples that are in the degraded packet. The resulting selected set of samples is taken to be the generated waveform. For example, if the data buffer has a length of 200 samples, the estimated pitch period is determined to have a length of 50 samples and the degraded packet has a length of 30 samples, then the replacement module 111 generates a waveform containing samples 151 to 180 of the data buffer.

If the degraded packet is longer than the estimated pitch period, then the set of samples equal to the length of the estimated pitch period is selected (in the above example this would be samples 151 to 200). This set of samples is repeated and used as the generated waveform to replace the degraded packet. Alternatively, a set of samples equal to the length of the degraded packet is selected from the data buffer 109. This is achieved by counting back sequentially in the data buffer, from the most recently received sample, by a number of samples equal to a multiple of the estimated pitch period. The multiple is chosen such that the number of samples counted back is longer than or equal to (no shorter than) the length of the degraded packet. The multiple may, for example, be 1. Typically the multiple will be 2 or 3 times the estimated pitch period. The sample that the replacement module counts back to is taken to be the first sample of the generated waveform. The replacement module 111 takes sequential samples up to the number of samples that are in the degraded packet. The resulting selected set of samples is taken to be the generated waveform. For example, if the data buffer has a length of 200 samples, the estimated pitch period is determined to have a length of 50 samples and the degraded packet has a length of 60 samples, then the replacement module 111 generates a waveform containing samples 101 to 160 of the data buffer.

Repeating a set of samples too many times can result in noticeable artefacts being present in the output signal. The output signal may, for example, sound artificial or robotic. By comparison, using a set of samples equal to the length of the degraded portion of the signal introduces some natural variation into the output signal. However, using a set of samples equal to the length of the degraded portion of the signal may result in greater discontinuities at the boundaries with the remaining signal if the degraded portion is long. This is because voice signals can only be considered to have constant pitch periods when viewed over short time intervals. Over long time intervals the pitch period changes. Therefore, if a long segment of buffered data is used to replace a degraded portion there may be a considerable mismatch at the boundaries with the remaining signal. The preferable option between the first method of repeating a set of samples and the second method of selecting a longer set of samples from the data buffer depends on the form of the particular signal in question. Thus, a hybrid approach may be used which dynamically selects the optimal of these two methods. For example, the optimal method may be chosen to be that which has a lower concatenation cost at the boundary with the remaining signal. If the degraded portion is very long it may be considered as a sequence of shorter degraded portion, each shorter degraded portion being assessed as described herein.

Alternatively, other known pitch based waveform substitution techniques utilising the estimated pitch period may be used by the replacement module 111.

The replacement module 111 outputs the generated waveform as the replacement packet to switch 104. Switch 104 is enabled under the control of degradation detector 102 to output the replacement packet to overlap-add module 105. At step 206, overlap-add module 105 applies an overlap-add algorithm at the concatenation points to minimise discontinuities at the boundaries between the replacement packet and the packets on either side of it.

At step 207, the replacement packet is output from the overlap-add module 105 and stored in data buffer 109. At step 208, the replacement packet output from the overlap-add module 105 is also output from the signal processing apparatus 100 on line 106.

The pitch period is estimated, at step 204, using a two-phase method. An optional third phase may be included in the method, at step 205, to refine the pitch period estimate.

An overview of the three phases will now be described followed by detailed example implementations of the phases.

In the first phase, a pitch period detection algorithm is used to search over a narrow range of potential pitch periods. A potential pitch period is a pitch period typically found in human voice signals. The narrow range of potential pitch periods is selected such that it covers the high end of the range of pitch periods typically found for human speech. Typically, pitch periods of human speech range between 2.5 ms (for a person with a high voice) to 16 ms (for a person with a low voice). This corresponds to a pitch frequency range of 400 Hz to 62.5 Hz. A suitable high bound of the narrow range of potential pitch periods selected for the first phase is therefore 16 ms. The low bound of the narrow range of potential pitch periods is less than or the same as half the high bound. This is so that at least one multiple of a candidate pitch period determined in the second phase (see next paragraph) is present in the narrow range of potential pitch periods searched over in this first range. Suitably, the low bound is half the high bound. In this example, a suitable low bound is therefore 8 ms. The pitch period detection algorithm selects the most likely candidate for the pitch period of the signal from the narrow range of potential pitch periods searched over. This candidate pitch period is referred to in the following as the first candidate pitch period.

In the second phase, further candidate pitch periods are determined using the first candidate pitch period identified in the first phase. Since only part (8 ms to 16 ms in the above example) of the total range of potential pitch periods (2.5 ms to 16 ms) is searched in the first phase, it is possible that the candidate pitch period identified in the first phase is a multiple of the 'true' pitch period of the signal. The second phase determines further candidate pitch periods from a range of potential pitch periods which covers the low end of the range of pitch periods expected for human speech. A suitable low bound of the range of potential pitch periods selected for the second phase is therefore 2.5 ms. Suitably, the range of potential pitch periods selected for the second phase excludes the narrow range selected for the first phase but includes other typical pitch periods of human speech. A suitable high bound of the range of potential pitch periods selected for the second phase is therefore the low bound of the narrow range selected for the first phase. In the example given, a suitable high bound for the range of potential pitch periods selected for the second phase is therefore 8 ms. The further candidate pitch periods determined in the second phase are such that multiples of these further candidate pitch periods give the first candidate pitch period. The first candidate pitch period identified in the first phase, and one or more of the further candidate pitch periods identified in the second phase are analysed using a pitch period detection algorithm. The smallest candidate pitch period that is identified by the pitch period detection algorithm as being likely to be the pitch period of the signal is selected to be the estimate of the pitch period of the signal.

An optional third phase may be included in the pitch period estimation method at step 205. The third phase refines the pitch period estimate to reduce distortion at the concatenation boundaries between a replacement packet selected using the pitch period estimate, and the packets of the signal on either side of the replacement packet. A narrow range of potential pitch periods encompassing the pitch period estimated in the second phase is selected. A fine search over this narrow range of potential pitch periods is carried out using a distance metric in order to determine a refined pitch period estimate. The distance metric matches a first small portion of the signal received just before (or just after) the degraded portion to portions of the signal separated from the first small portion by particular time intervals. These time intervals are chosen to be candidate pitch periods in the narrow range of potential pitch periods encompassing the pitch period estimate in the second phase. The candidate pitch period associated with the best matched portions (i.e. the portions that minimise the distance metric) is selected to be the refined estimate of the pitch period of the signal.

Exemplary methods of implementing these three phases will now be described with reference to the flow chart of FIG. 3.

First Phase

Figure 3:
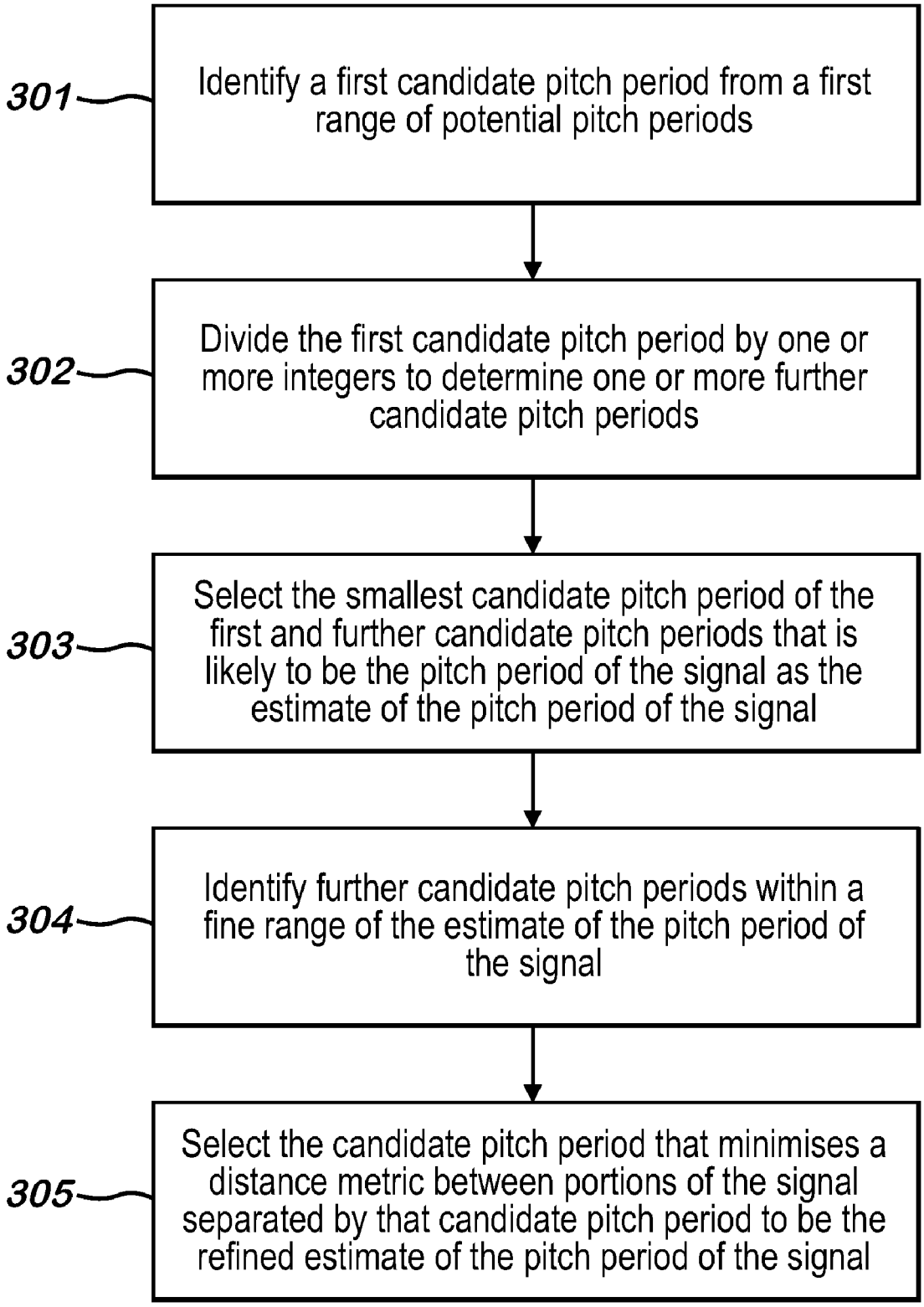
FIG. 3 is a flow chart of a method for estimating the pitch period of a signal.

At step 301 of FIG. 3, a first candidate pitch period is identified from a first range of potential pitch periods. A pitch period detection algorithm is used to search over this range.

There are numerous well known pitch period detection algorithms commonly used in the art that could be used in the first phase of this method. Examples of metrics utilised by these algorithms are normalised cross-correlation (NCC), sum of squared differences (SSD), and average magnitude difference function (AMDF). Algorithms utilising these metrics offer similar pitch period detection performance. The selection of one algorithm over another may depend on the efficiency of the algorithm, which in turn may depend on the hardware platform being used.

To illustrate the method described herein, a normalised cross-correlation (NCC) metric will be used. Such a method can be expressed mathematically as:

$$NCC_t(\tau) = \frac{\sum_{n=-N/2}^{(N/2)-1} x[t+n]x[t+n-\tau]}{\sqrt{\sum_{n=-N/2}^{(N/2)-1} x^2[t+n] \sum_{n=-N/2}^{(N/2)-1} x^2[t+n-\tau]}} \quad \text{(equation 1)}$$

where x is the amplitude of the voice signal and t is time. The equation represents a correlation between two segments of the voice signal which are separated by a time $\tau$. Each of the two segments is split up into N samples. The nth sample of the first segment is correlated against the respective nth sample of the other segment. This equation is repeated over time separations incremented over the range $\tau_{min} \leq \tau < \tau_{max}$.

Figure 4:
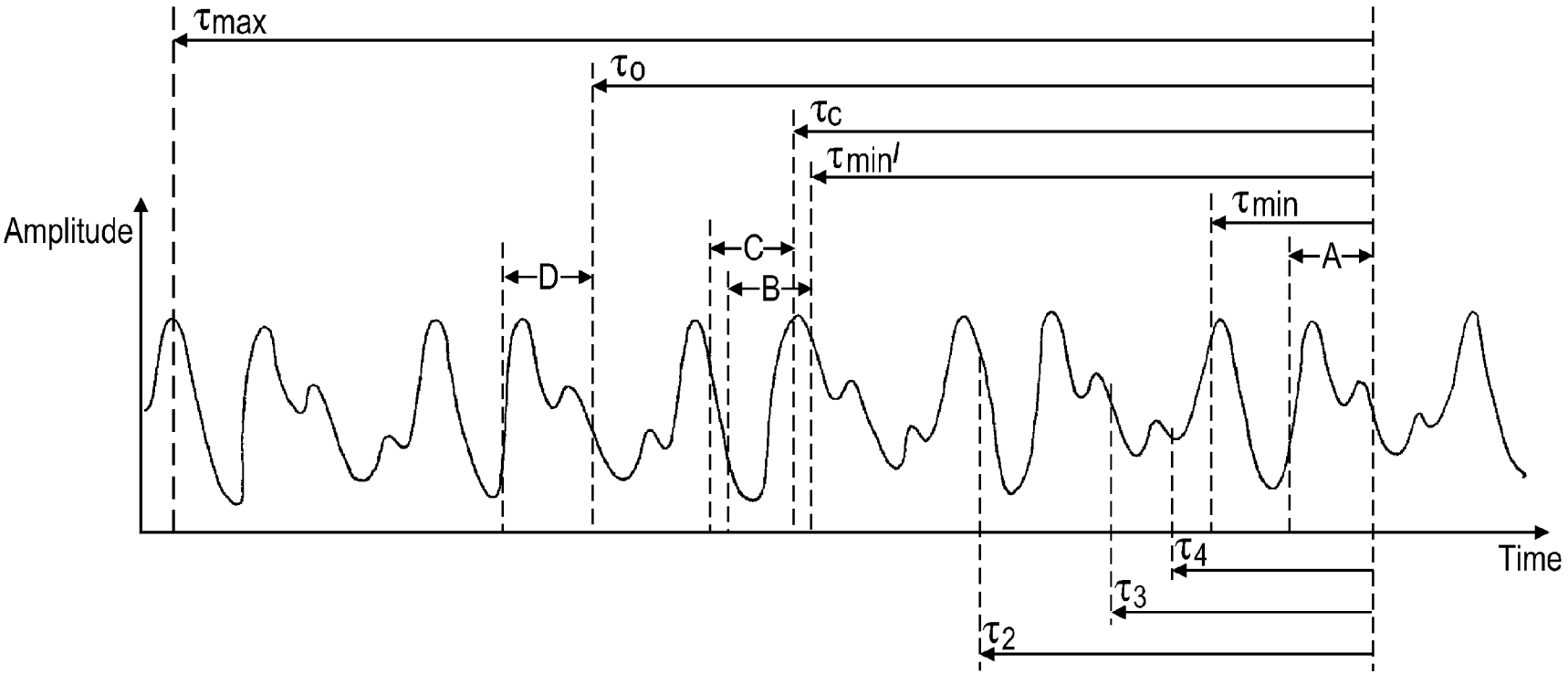
FIG. 4 is a graph of a typical voice signal illustrating a cross-correlation method.

This equation essentially takes a first segment of a signal (marked A on FIG. 4) and correlates it with each of a number of further segments of the signal (for ease of illustration only three, marked B, C and D, are shown on FIG. 4). Each of these further segments lags the first segment along the time axis by a lag value ($\tau_{min}$, for segment B, $\tau_C$ for segment C). In the first phase of this method, the NCC calculation is carried out over a narrow range of lag values covering the high end of pitch periods expected for human speech. The range illustrated on FIG. 4 is from $\tau_{min}$, to $\tau_{max}$. Suitably, $\tau_{min}$, is 8 ms and $\tau_{max}$ is 16 ms. The term on the bottom of the fraction in equation 1 is a normalising factor. The lag value $\tau_0$ that maximises the NCC function represents the time interval between the segment A and the segment in the searched range ($\tau_{min}$, to $\tau_{max}$) with which it is most highly correlated (segment D on FIG. 4). This lag value $\tau_0$ is taken to be the most likely candidate for the pitch period of the signal from the narrow range of potential pitch period searched over. This is the first candidate pitch period.

The first candidate pitch period, $\tau_0$, can be expressed mathematically as:

$$\tau_0 = \underset{\tau}{\operatorname{argmax}} NCC_t(\tau) \quad \text{(equation 2)}$$

Voice signals are typically sampled at a rate of 8 kHz. Searching a lag value range of 8 ms to 16 ms corresponds to searching a pitch frequency range of 125 Hz to 62.5 Hz. The corresponding sample range is 64 samples to 128 samples. A number of samples can be calculated from the sampling rate and a corresponding frequency by:

$$\text{number of samples} = \text{sampling rate}/\text{frequency} \quad \text{(equation 3)}$$

Decimation may used in conjunction with the NCC metric. Decimation is the process of removing or discounting samples at regular intervals. Decimation may be applied to the input signal and/or the lag values $\tau$. For example, referring to equation 1 and FIG. 4, applying a decimation of 2:1 to the input signal means that every other sample of segment A will be correlated against the corresponding every other sample of segment B, and so on. Similarly, applying a decimation of 2:1 to the lag values $\tau$ means that the calculation of equation 1 is carried out for every other possible $\tau$ value, for example 64 samples, 66 samples, 68 samples and so on. Decimating either the input signal or the lag value allows a reduction in processing complexity (of 50% for each 2:1 decimation) at the expense of some performance degradation.

The numerator of equation 1 can be efficiently computed using a fast multiply-accumulate (MAC) operation. To avoid the calculation of the relatively computationally heavy square root function in the denominator, the following approximation may be used:

$$NCC_t(\tau) = \frac{\sum_{n=-N/2}^{(N/2)-1} x[t+n]x[t+n-\tau]}{\sum_{n=-N/2}^{(N/2)-1} x^2[t+n-\tau]} \quad \text{(equation 4)}$$

The term $$\sum_{n=-N/2}^{(N/2)-1} x^2[t+n-\tau]$$

can be efficiently computed in a recursive manner.

Second Phase

At step 302 of FIG. 3, the first candidate pitch period determined from the first phase is divided by one or more integers to determine one or more further candidate pitch periods.

As described above, further candidate pitch periods are suitably identified from the range of pitch periods expected for human speech excluding the narrow range searched over in the first phase of the method. The range searched over in the second phase is illustrated on FIG. 4 as $\tau_{min} \leqq \tau < \tau_{min'}$. In the example used in the first phase, this corresponds to 2.5 ms$\leqq\tau$<8 ms.

The further pitch period candidates, $\tau_i$, can be calculated mathematically as follows:

$$\tau_i = \max\left(\left\lfloor \frac{\tau_o}{i} + 0.5 \right\rfloor, \tau_{min}\right) \quad \text{(equation 5)}$$

where i is an integer satisfying the following expression:

$$i = 1, 2, 3 \ldots \left\lfloor \frac{\tau_{max}}{\tau_{min}} \right\rfloor \quad \text{(equation 6)}$$

$\lfloor\ \rfloor$ is a floor operator which maps a real number to the next smallest integer. Consequently, $\lfloor x+0.5 \rfloor$ maps real number x to the nearest integer.

Equation 5 determines each further candidate pitch period by dividing the first candidate pitch period $\tau_0$ by an integer i, rounding the result of this division to the nearest whole number using the floor operator, and selecting the largest of the resulting rounded number and the minimum pitch period $\tau_{min}$ expected for human speech. Equation 5 is computed for integers in the range specified by equation 6. Equation 6 expresses that all integers are used in the range starting at 1 and ending at the next smallest integer to the result of the maximum pitch period $\tau_{max}$ expected for human speech divided by the minimum pitch period $\tau_{min}$ expected for human speech.

As an example, if, referring to FIG. 4:

$\tau_0$=12 ms, $\tau_{min}$=2.5 ms, and $\tau_{max}$=16 ms, then equation 6 gives:

$$i = 1, 2, 3 \ldots \left\lfloor \frac{16}{2.5} \right\rfloor = 1, 2, 3 \ldots \lfloor 6.4 \rfloor = 1, 2, 3, \ldots 6 \quad \text{(equation 7)}$$

and equation 5 gives:

$$\tau_i = \max\left(\left\lfloor \frac{12}{i} + 0.5 \right\rfloor, 2.5\right) \quad \text{(equation 8)}$$

This yields three further candidate pitch periods in the range 2.5 ms to 8 ms. These are:

$\tau_2$=6 ms, $\tau_3$=4 ms, and $\tau_4$=3 ms

These three further candidate pitch periods are illustrated on FIG. 4.

At a sampling rate of 8 kHz, the first candidate pitch period determined in the first phase corresponds to 96 samples. The further candidate pitch periods determined in the second phase correspond to the following numbers of samples:

$\tau_2$=48 samples, $\tau_3$=32 samples, and $\tau_4$=24 samples

At step 303 of FIG. 3, the smallest candidate pitch period of the first and further candidate pitch periods that is likely to be the pitch period of the signal is selected as the estimate of the pitch period of the signal. As with the first phase, numerous pitch period detection algorithms commonly used in the art can be used to implement this step, for example normalised cross-correlation, sum of squared differences, and average magnitude difference function. To illustrate the method described herein, a normalised cross-correlation (NCC) metric will be used.

One method of determining the pitch period most likely to be the pitch period of the signal is to perform the NCC calculation of equation 1 on lag values $\tau$ corresponding to each of the candidate pitch periods. The candidate pitch periods referred to here are the first candidate pitch period identified in the first phase of the method and the further candidate pitch periods determined in the second phase of the method. The lag value with the maximum NCC is then selected as the estimate of the pitch period of the signal.

The selected estimate of the pitch period $\tau_0'$ according to this method can be expressed as:

$$\tau_0' = \underset{\tau_i}{\operatorname{argmax}} NCC_t(\tau_i) \quad \text{(equation 9)}$$

In the example referred to above, there are four candidate pitch periods:

$\tau_0$=12 ms, $\tau_2$=6 ms, $\tau_3$=4 ms, and $\tau_4$=3 ms

As can be seen on FIG. 4, the signal is highly repetitive over the time interval displayed. In other words, the signal has a low pitch period. In the first phase, when searching over the range $\tau_{min'} \leqq \tau < \tau_{max}$, segment D was found to be most highly correlated with segment A, yielding the first candidate pitch period $\tau_0$. As can be seen from FIG. 4, segment D is the third segment removed from segment A along the time axis that is highly correlated with segment A. There are two segments closer to segment A in time that are also highly correlated with segment A. These two segments lie outside the range searched over in the first phase of the method. The first candidate pitch period $\tau_0$ is actually three times the 'true' pitch period. On performing the NCC metric of equation 1 for each of the four candidate pitch periods $\tau_0$ to $\tau_4$, $\tau_2$=6 ms and $\tau_4$=3 ms are found not to be highly correlated. The candidate pitch period $\tau_3$=4 ms is highly correlated. The larger of $\tau_0$ and $\tau_3$ will be selected to be the estimate of the pitch period of the signal if equation 9 is used. In this case $\tau_3$ would be expected to produce a higher correlation value. This is because the approximation that the pitch period of a voice signal is constant is more accurate over short time intervals than longer time intervals. It would therefore be expected that portions of a signal separated by one pitch period would be more highly correlated than portions of a signal separated by two or more pitch periods.

Using equation 9 to select the estimate of the pitch period may, however, sometimes select a candidate pitch period which is the multiple of the 'true' pitch period not the actual 'true' pitch period. This will occur if segments of the signal (selected to perform the NCC metric of equation 1) separated by the multiple of the 'true' pitch period happen to be more highly correlated than segments of the signal separated by the 'true' pitch period.

An alternative method of selecting the estimate of the pitch period is illustrated using the following pseudo code:

$$\tau_0' = \tau_0 \qquad \text{(equation 10)}$$

for $i = \left\lfloor \frac{\tau_{max}}{\tau_{min}} \right\rfloor \ldots 2$ if $NCC_t(\tau_i) > \alpha \cdot NCC_t(\tau_0)$ $\tau_0' = \tau_0$ break end end Where $\alpha$ is a constant with a typical value between 0.9 and 1.

This pseudo code first calculates the NCC metric for the first candidate pitch period, $\tau_0$. It provisionally sets this, denoted $NCC_t(\tau_0)$ in equation 10, to be the estimate of the pitch period of the signal $\tau_0'$. The pseudo code then selects the smallest candidate pitch period for use in the next step of the code. The smallest candidate pitch period is determined from equation 5 using the largest integer satisfying the expression in equation 6. The pseudo code calculates the NCC metric for the smallest candidate pitch period. If the NCC metric for the smallest candidate pitch period is greater than a predetermined value times the NCC metric for the first candidate pitch period, then the smallest candidate pitch period is selected to be the estimate of the pitch period of the signal, $\tau_0'$. The predetermined value is denoted $\alpha$ in equation 10 and typically chosen to have a value between 0.9 and 1.

Selecting $\alpha$ to be less than 1 overcomes the problem of a multiple of the pitch period unintentionally being selected to be the estimate of the pitch period of the signal.

If the NCC metric for the smallest candidate pitch period is less than or the same as the predetermined value times the NCC metric for the first candidate pitch period, then the smallest candidate pitch period is not selected as the estimate of the pitch period of the signal. Instead, the NCC metric for the next smallest candidate pitch period is calculated and the method described above in relation to the smallest candidate pitch period is repeated.

This process is repeated using sequentially increasing candidate pitch periods until a candidate pitch period yielding an NCC metric greater than $\alpha$ times the NCC metric for the first candidate pitch period is found. This candidate pitch period is then selected as the estimate of the pitch period of the signal, $\tau_0'$.

If none of the candidate pitch periods are found to yield an NCC metric greater than ox times the NCC metric for the first candidate pitch period, then the first candidate pitch period is selected to be the estimate of the pitch period of the signal, $\tau_0'$.

The pseudo code avoids calculating the NCC metric for larger candidate pitch periods than the candidate pitch period ultimately selected to be the estimated pitch period of the signal (except the first candidate pitch period). It therefore generally involves fewer calculations than the alternative method described in relation to equation 9.

Alternatively, to further reduce the computational complexity involved in the method, only one further candidate pitch period may be determined and analysed. Any suitable further candidate pitch period may be determined. However, preferably the further candidate pitch period $\tau_2$ calculated using i=2 in equation 5 is analysed. This is because it is the most likely of the further candidate pitch periods to yield a high correlation. Analysing the further candidate pitch period $\tau_2$ reduces the likelihood that a multiple of the 'true' pitch period will be selected as the estimated pitch period of the signal. However, if $\tau_2$ is selected as the estimate of the pitch period it will still be possible, in some cases, that $\tau_2$ is a multiple of the 'true' pitch period. Optionally, the second phase can be extended by performing a fine search around the vicinity of the estimated pitch period, $\tau_0'$, using the NCC metric. For example, the NCC metric can be calculated for k time lags on either side of the estimated pitch period. A refined estimate of the pitch period is then given by the time lag that maximised the NCC metric.

Third Phase

The estimate of the pitch period calculated in the second phase, $\tau_0'$, is optimal in the sense of maximising the NCC metric. However, on insertion into a voice signal, a replacement packet that has been generated in dependence on the estimated pitch period may still contain discontinuities at the boundaries with the packets on either side of it. These discontinuities occur because although voice signals are quasi-periodic they are not truly periodic. Hence a waveform substitution technique that is based on the assumption that voice signals are truly periodic (for example one that selects a substituted waveform based on an estimated pitch period of the signal) may not provide a waveform which fits seamlessly into the gap left by the degraded packet.

Typically, cross-fading of the signals on either side of a boundary is used to reduce the discontinuity at the boundary. This is sometimes referred to as an overlap-add (OLA) operation and is carried out at step 206 of FIG. 2.

In the OLA operation, the ending portion of the packet prior to the degraded packet is multiplied by a down-sloping ramp. The beginning portion of the packet following the degraded packet is multiplied by an up-sloping ramp. This is normally achieved using a triangular window. Other more sophisticated window functions such as a hamming window or a hann window may also be used. If the overlap length is L and the window length is M=2L, then the OLA ramp is given by:

$$w(n) = \frac{2}{M} \cdot \left( \frac{M}{2} - \left| n - \frac{M-1}{2} \right| \right) \qquad \text{(equation 11)}$$

where $0 \leqq n \leqq M-1$

The overlap length L determines how much cross-fading is performed at the boundary. It is normally shorter than the packet length. For example, a common packet length in Bluetooth is 30 samples (HV3/eV3 packet types). Suitably, an overlap length of 10 samples is used to perform cross-fading at the boundary. If the OLA length is fixed then the window function parameters can be pre-stored. When suitable resources are available, the OLA length may be dynamically set proportional to the estimated pitch period and the packet length.

Despite use of an OLA operation, discontinuities often remain a problem and are noticeable as artefacts in the output voice signal. The optional third phase of this method reduces the mismatch between the two segments used for the OLA operation. This is achieved by using the replacement packet and the packets on one or both sides of the replacement packet to refine the pitch period estimate and thereby reduce the distortion at the concatenation boundaries.

Figure 5:
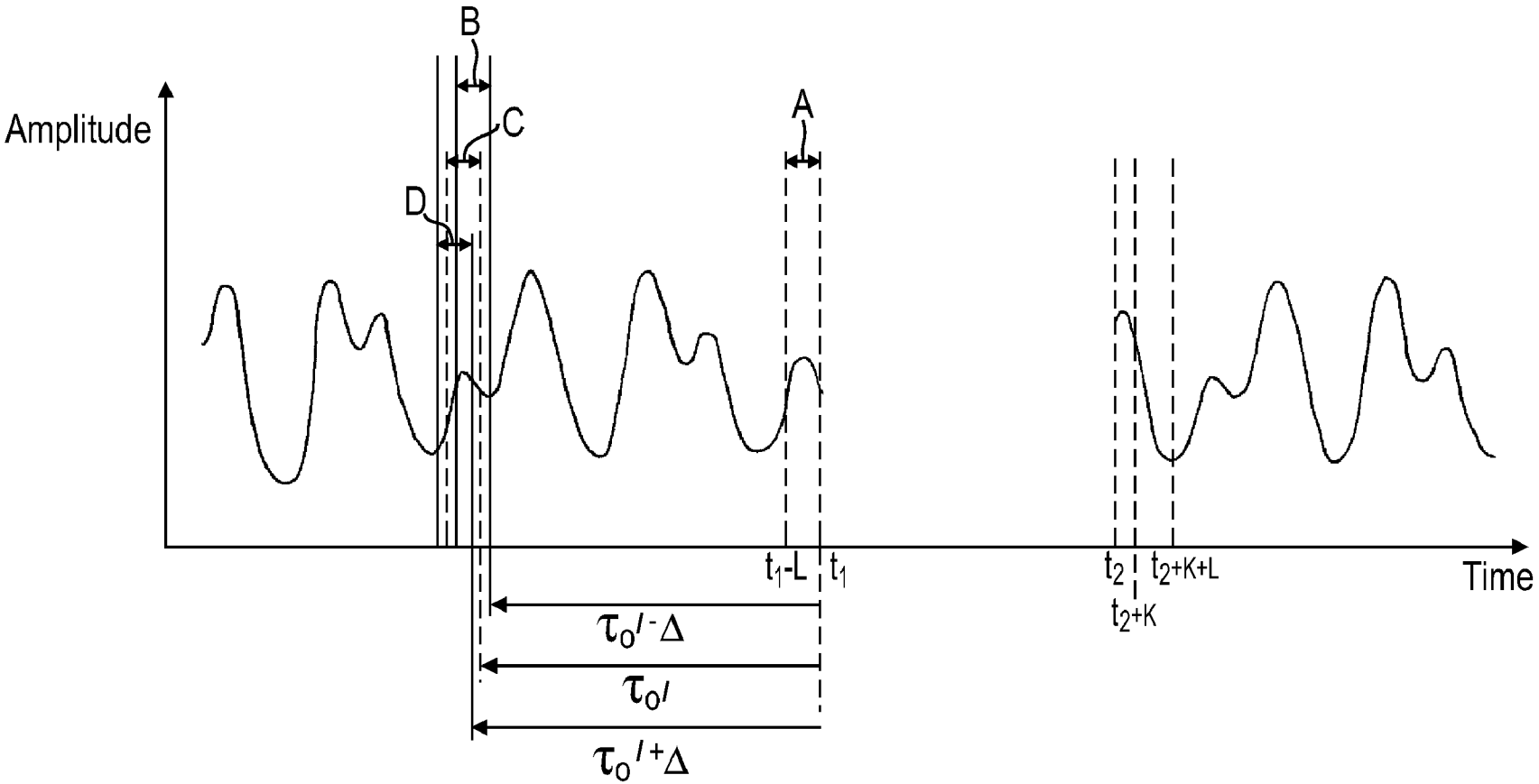
FIG. 5 is a graph of a typical voice signal comprising a degraded portion.

FIG. 5 shows a voice signal comprising a degraded portion. The degraded portion is illustrated as a portion with no amplitude. The degraded portion starts at time $t_1$ and ends at time $t_2$. A portion of the signal of length L immediately preceding the degraded portion (from time $t_1-L$ to time $t_1$) and a portion of the signal of length L immediately following the degraded portion (from time $t_2$ to $t_2+L$) are used in the OLA operation.

At step 304 of FIG. 3, a fine pitch period search range encompassing the estimated pitch period determined in the second phase of the method is selected. The fine pitch period search range includes this estimated pitch period and further candidate pitch periods proximal to this estimated pitch period.

The fine pitch period search range can be expressed as:

$$\tau_0'-\Delta \leqq \tau_j \leqq \tau_0'+\Delta \quad \text{(equation 12)}$$

Candidate pitch periods, $\tau_j$, for the refined pitch period estimate determined in the third phase lie within $\pm\Delta$ of the pitch period estimated in the second phase, $\tau_0'$.

At step 305 of FIG. 3, the candidate pitch period that minimises a distance metric between portions of the signal separated by that candidate pitch period is selected to be the refined estimate of the pitch period of the signal.

There are numerous well known distance metrics commonly used in the art that could be used in the third phase of this method. Examples include Euclidean distance, Mahalanobis distance and correlation coefficient. The selection of one metric over another may depend on the efficiency of the metric, which in turn may depend on the hardware platform being used.

To illustrate the method described herein, Euclidean distance will be used.

The Euclidean distance, $D_1$, can be expressed mathematically as:

$$D_1(\tau_j) = \sqrt{\sum_{n=1}^{L} (x[t_1-n] - x[t_1-n-\tau_j])^2} \quad \text{(equation 13)}$$

where x is the amplitude of the voice signal and t is time. The equation represents a correlation between two segments of the voice signal which are separated by a time $\tau_j$. Each of the two segments is split up into L samples. The nth sample of the first segment is correlated against the respective nth sample of the other segment. This equation is calculated for each incremental candidate pitch period in the range $\tau_0'-\Delta \leqq \tau_j \leqq \tau_0'+\Delta$.

This equation takes a segment of a signal immediately preceding the degraded portion (marked A on FIG. 5) and correlates it with each of a number of further segments of the signal (for ease of illustration only three, marked B, C and D, are shown on FIG. 5). Each of these further segments lags the first segment along the time axis by a lag value ($\tau_0'-\Delta$ for segment B, $\tau_0'$ for segment C and $\tau_0'+\Delta$ for segment D).

The term correlate is used herein to express a method by which a measure of the similarity between two variables or data series can be determined. The measure is preferably a quantitative measure. A correlation could involve computing the inner product of two vectors. Alternatively, a correlation could involve other mechanisms.

The refined estimate of the pitch period is selected to be the candidate pitch period associated with the smallest Euclidean distance. This refined estimate of the pitch period, $\tau_0''$, can be expressed mathematically as:

$$\tau_0'' = \underset{\tau_j}{\operatorname{argmin}} D_1(\tau_j) \quad \text{(equation 14)}$$

If sufficient samples following the degraded portion are available, then a second Euclidean distance $D_2$ can be calculated for each candidate pitch period, $\tau_j$. The initial portion of the first packet after the degraded portion may also be degraded. This may arise, for example, if the decoder relies at least in part on its internal state to decode a packet of data, and its internal state is in turn reliant on previously decoded packets. In this situation, a degraded packet may lead to the decoder state not being properly updated. The severity of the degradation of the first packet after the degraded portion depends on the length of the degraded portion, the robustness of the codec being used, and on any decoder state update logic that is implemented when a degraded portion is processed. The samples following the degraded portion that are used to calculate $D_2$ are chosen so as to reduce the likelihood that they are from unreliable data immediately following the degraded portion. If k samples at the beginning of the packet after the degraded portion are considered to be unreliable, then L samples from $t_2+k$ to $t_2+k+L$ (illustrated on FIG. 5) are therefore selected for use in calculating $D_2$.

The Euclidean distance, $D_2$, can be expressed mathematically as:

$$D_2(\tau_j) = \sqrt{\sum_{n=k}^{k+L} (x[t_2+n] - x[t_2+n\pm\tau_j])^2} \quad \text{(equation 15)}$$

where the terms are defined as they are in equation 13.

This equation takes a segment of a signal following the degraded portion and correlates it with each of a number of further segments of the signal. Each of these further segments lags the first segment along the time axis by a lag value, $\tau_j$, and the ± in equation 15 is a minus sign, −. If future data is available, the replacement portion for the degraded portion may be selected from the future data. The segment of the signal following the degraded portion may be correlated with further segments that lead it along the time axis by a lead value, $\tau_j$, and the ± in equation 15 is a plus sign, +.

The refined estimate of the pitch period is selected to be the candidate pitch period associated with the smallest overall Euclidean distance. Suitably, the mean average of the first Euclidean distance and the second Euclidean distance is calculated for each candidate pitch period and set as the overall Euclidean distance for that candidate pitch period. For example, the refined estimate of the pitch period, $\tau_0''$, may be expressed mathematically as:

$$\tau_0'' = \underset{\tau_j}{\operatorname{argmin}} \frac{D_1(\tau_j) + D_2(\tau_j)}{2} \quad \text{(equation 16)}$$

Typically, prior systems use a pitch period detection algorithm to search for the pitch period of a signal over the whole range of expected pitch periods for human voices (for example 2.5 ms to 16 ms). This is often performed in two stages: a coarse search over the whole range followed by a fine search on a target area. The method and apparatus disclosed herein advantageously initially perform a search for the pitch period of a signal only over a narrow range of expected pitch periods (for example 8 ms to 16 ms). A candidate pitch period in this narrow range detected by the algorithm is utilised to identify one or more further candidate pitch periods in the rest of the range of expected pitch periods (for example 2.5 ms to 8 ms). A further pitch period detection algorithm is performed locally on the one or more targeted candidate pitch periods.

Pitch period detection algorithms are computationally heavy, particularly for low-power platforms such as Bluetooth. Searching for the pitch period in a narrower range than the whole range of expected pitch periods reduces the computational complexity associated with the process. For example, performing an NCC method over an initial pitch period range of 8 ms to 16 ms instead of 2.5 ms to 16 ms corresponds to a saving in computational complexity of approximately 40%.

A reduction in computational complexity has been achieved in prior systems by reducing the granularity of the search, in other words by performing a coarse search of the whole range of expected pitch periods. However, this is at the cost of a reduction in performance of the process. By searching a narrower range of expected pitch periods, a comparable reduction in computational complexity is achieved by the method described herein without suffering the performance degradation associated with a coarse search. Minimal additional complexity is introduced by the localised searches on the targeted candidate pitch periods identified in the remaining range of expected pitch periods. Additionally, performing a coarse search (for example using decimation of the input signal and/or lag values), over the narrow range of expected pitch periods as described herein further reduces the computational complexity involved resulting in a process that is substantially less computationally complex than the prior systems described without any additional cost to the performance of the process.

The method described herein is effective because if the 'true' pitch period lies outside the narrow range searched in the first phase, then as long as the narrow range encompasses at least the upper half of the expected pitch period range, a multiple of the 'true' pitch period will be identified in the narrow range searched in the first phase. The 'true' pitch period will consequently be targeted as a candidate pitch period in the second phase of the method described, and selected as the estimate of the pitch period.

In many cases it may be sufficient to use the first candidate pitch period identified in the first phase of the method (which may be a multiple of the 'true' pitch period) as the estimate of the pitch period, for example for some signals in which the degraded portion is longer than the estimated pitch period. However, when the voice signal has a fast pitch period variation, it is preferable to use a shorter pitch period than the first candidate pitch period (if the first candidate pitch period is a multiple of the 'true' pitch period) in order to minimise mismatch at the concatenation boundaries between the replacement packet and the packets on either side of it. For this reason, it is preferable to perform the second phase of this method to find an estimate of the 'true' pitch period, or at least an estimate of a smaller multiple of the 'true' pitch period than the first candidate pitch period.

The third phase of the method described refines the estimate of the pitch period to achieve a smooth transition at the concatenation boundaries between the replacement packet and the packets on either side of it. In some prior systems, pitch period estimates are refined using a further NCC metric. The method described herein achieves such a refinement by utilising a geometric distance metric. The distance metric involves a correlation between portions of the signal, each comprising L samples. An NCC metric involves a correlation between portions of the signal, each comprising N samples. For a typical signal sampling rate of 8 kHz, N is typically of the order of several hundreds. By comparison, L is typically below 30 samples. The computational complexity involved in the pitch period estimate refinement method described herein is therefore reduced compared to methods utilising a NCC pitch period estimate refinement method. Furthermore, the method described herein refines the pitch period estimation using the portions of the signal used for cross-fading with the replacement portion. Minimising the mismatch of the cross-fading regions leads to a smoother transition across the concatenation boundaries than in prior systems. Using samples following the degraded portion in addition to samples preceding the degraded portion when computing the distance metrics, as described herein, results in smoother transitions being achieved than if only data preceding the degraded portion is utilised.

In the first and second phases of the method described, any pitch period detection algorithm can be used, including frequency domain approaches, as long as the candidate pitch periods determined in the second phase can be compared with the first candidate pitch period determined in the first phase using quantitative measures.

FIG. 1 is a schematic diagram of the apparatus described herein. The method described does not have to be implemented at the dedicated blocks depicted in FIG. 1. The functionality of each block could be carried out by another one of the blocks described or using other apparatus. For example, the method described herein could be implemented partially or entirely in software.

The method described is useful for packet loss/error concealment techniques implemented in wireless voice or VoIP communications. The method is particularly useful for products such as some Bluetooth and Wi-Fi products that involve applications with coded audio transmissions such as music streaming and hands-free phone calls.

Figure 6:
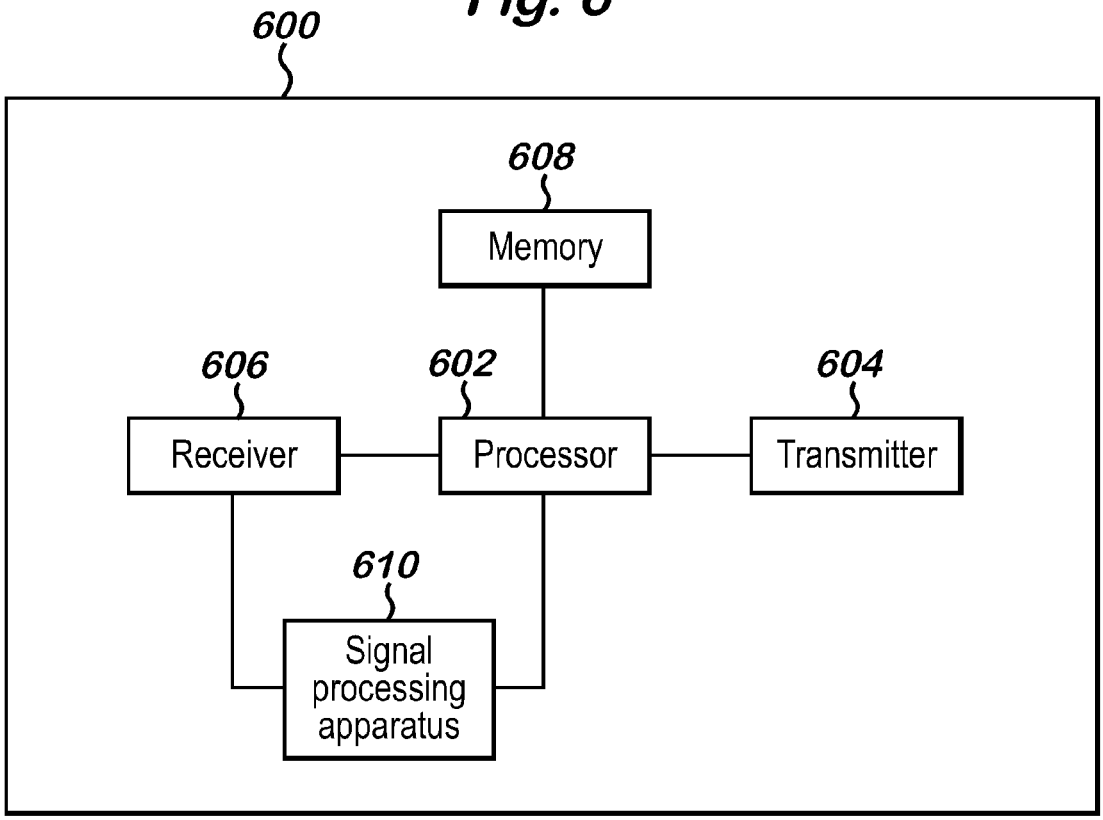
FIG. 6 is a schematic diagram of a transceiver suitable for comprising the signal processing apparatus of FIG. 1.

The pitch period estimation apparatus of FIG. 1 could usefully be implemented in a transceiver. FIG. 6 illustrates such a transceiver 600. A processor 602 is connected to a transmitter 604, a receiver 606, a memory 608 and a signal processing apparatus 610. Any suitable transmitter, receiver, memory and processor known to a person skilled in the art could be implemented in the transceiver. Preferably, the signal processing apparatus 610 comprises the apparatus of FIG. 1. The signal processing apparatus is additionally connected to the receiver 606. The signals received and demodulated by the receiver may be passed directly to the signal processing apparatus for processing. Alternatively, the received signals may be stored in memory 608 before being passed to the signal processing apparatus. The transceiver of FIG. 6 could suitably be implemented as a wireless telecommunications device. Examples of such wireless telecommunications devices include handsets, desktop speakers and handheld mobile phones.

The applicant draws attention to the fact that the present invention may include any feature or combination of features disclosed herein either implicitly or explicitly or any generalisation thereof, without limitation to the scope of any of the present claims. In view of the foregoing description it will be evident to a person skilled in the art that various modifications may be made within the scope of the invention.

The invention claimed is:

1. A method of estimating the pitch period of a signal comprising:

identifying a first candidate pitch period, using a processor, by performing a search only over a first range of potential pitch periods;

determining a second candidate pitch period by dividing the first candidate pitch period by an integer, the second candidate pitch period being outside the first range of potential pitch periods; and selecting as the estimate of the pitch period of the signal the smaller of the candidate pitch periods that is such that portions of the signal separated by that candidate pitch period are well correlated;

wherein the high bound of the first range of potential pitch periods is the largest potential pitch period, the low bound of the first range of potential pitch periods is less than or the same as half the largest potential pitch period, and the integer is such that the second candidate pitch period is greater than the smallest potential pitch period.

2. A method as claimed in claim 1, comprising identifying a first candidate pitch period using a pitch period detection algorithm.

3. A method as claimed in claim 2, wherein the pitch period detection algorithm is a normalised cross correlation algorithm.

4. A method as claimed in claim 1, wherein the signal is sampled, the first candidate pitch period being a first number of samples and the second candidate pitch period being a second number of samples, and wherein the second number of samples is determined by:

dividing the first number of samples by an integer; and selecting the whole number nearest to the division result to be the second number of samples.

5. A method as claimed in claim 1, further comprising correlating portions of the signal separated by the first candidate pitch period to form a first correlation value, and correlating portions of the signal separated by the second candidate pitch period to form a second correlation value.

6. A method as claimed in claim 5, comprising selecting as the estimate of the pitch period of the signal the second candidate pitch period if the second correlation value is greater than a predetermined proportion of the first correlation value.

7. A method as claimed in claim 5, comprising selecting as the estimate of the pitch period of the signal the first candidate pitch period if the second correlation value is less than a predetermined portion of the first correlation value.

8. A method as claimed in claim 5, comprising selecting as the estimate of the pitch period of the signal the candidate pitch period associated with the larger of the correlation values.

9. A method as claimed in claim 1, further comprising decimating the signal prior to identifying the first candidate pitch period.

10. A method of generating a replacement portion to replace a degraded portion of the signal comprising:

selecting a sample of the signal that precedes or follows the degraded portion by a multiple of an estimated pitch period; and forming the replacement portion from the selected sample and samples successive to the selected sample;

wherein the estimated pitch period is determined according to the method of claim 1.

11. A method as claimed in claim 10, wherein the multiple is one or an integer greater than one.

12. A method as claimed in claim 10, further comprising, on replacing the degraded portion with the replacement portion, applying an overlap-add algorithm to a boundary between the replacement portion and a portion of the signal adjacent to the replacement portion.

13. A method as claimed in claim 1, further comprising refining the estimate of the pitch period of the signal by:

for each candidate pitch period of a set of candidate pitch periods including the estimated pitch period and further candidate pitch periods proximal to the estimated pitch period, determining a geometric distance between portions of the signal separated by that candidate pitch period; and selecting as the refined estimated of the pitch period of the signal the candidate pitch period of the set of candidate pitch periods with the smallest associated geometric distance.

14. A method of generating a replacement portion to replace a degraded portion of the signal comprising:

selecting a sample of the signal that precedes or follows the degraded portion by a multiple of a refined estimated pitch period; and forming the replacement portion from the selected sample and samples successive to the selected sample;

wherein the refined estimated pitch period is determined according to the method of claim 13.

15. A method as claimed in claim 14, comprising, for each candidate pitch period of the set of candidate pitch periods, determining a geometric distance between a first portion of the signal and a second portion of the signal, wherein the first portion is proximal to and before or after the degraded portion, and the second portion is separated from the first portion by that candidate pitch period.

16. A method as claimed in claim 14, comprising for each candidate pitch period of the set of candidate pitch periods, determining a geometric distance by determining a first geometric distance between a first portion of the signal and a second portion of the signal, wherein the first portion is proximal to and before the degraded portion and the second portion is separated from the first portion by that candidate pitch period;

determining a second geometric distance between a third portion of the signal and a fourth portion of the signal, wherein the third portion is proximal to and after the degraded portion and the fourth portion is separated from the third portion by that candidate pitch period; and selecting the average of the first geometric distance and the second geometric distance to be the geometric distance.

17. A method as claimed in claim 13, comprising:

identifying a first candidate pitch period using a pitch period detection algorithm that compares portions of the signal each consisting of N samples; and for each candidate pitch period of the set of candidate pitch periods, determining a geometric distance between portions of the signal each consisting of L samples, wherein L is less than N.

18. A method as claimed in claim 14, further comprising, on replacing the degraded portion with the replacement portion, applying an overlap-add algorithm to a boundary between the replacement portion and a portion of the signal adjacent to the replacement portion.

19. A pitch period estimation apparatus, comprising:

a candidate pitch period identification module configured to identify a first candidate pitch period of a signal by performing a search only over a first range of potential pitch periods;

a processing module configured to determine a second candidate pitch period of the signal by dividing the first candidate pitch period by an integer, the second candidate pitch period being outside the first range of potential pitch periods;

and a selection module configured to select as the estimate of the pitch period of the signal the smaller of the candidate pitch periods that is such that portions of the signal separated by that candidate pitch period are well correlated;

wherein the high bound of the first range of potential pitch periods is the largest potential pitch period, the low bound of the first range of potential pitch periods is less than or the same as half the largest potential pitch period, and the integer is such that the second candidate pitch period is greater than the smallest potential pitch period.

* * * * *